US009905967B2

(12) United States Patent
Wang et al.

(10) Patent No.: US 9,905,967 B2
(45) Date of Patent: Feb. 27, 2018

(54) SOCKET OUTLET WITH EXPANSION MODULE

(71) Applicants: Pei-Lun Wang, Keelung (TW); Xinping Luo, Hengnan County (CN)

(72) Inventors: Pei-Lun Wang, Keelung (TW); Xinping Luo, Hengnan County (CN)

( * ) Notice: Subject to any disclaimer, the term of this patent is extended or adjusted under 35 U.S.C. 154(b) by 0 days.

(21) Appl. No.: 15/167,663

(22) Filed: May 27, 2016

(65) Prior Publication Data

US 2016/0359266 A1 Dec. 8, 2016

(30) Foreign Application Priority Data

Jun. 2, 2015 (TW) ..... 104117855 A

(51) Int. Cl.
*H01R 12/00* (2006.01)
*H01R 13/631* (2006.01)
(Continued)

(52) U.S. Cl.
CPC ..... *H01R 13/631* (2013.01); *H01R 24/38* (2013.01); *H01R 25/003* (2013.01); *H01R 27/02* (2013.01);
(Continued)

(58) Field of Classification Search
CPC .... H01R 2103/00; H01R 27/00; H01R 13/03; H01R 24/58; H01R 31/02
(Continued)

(56) References Cited

U.S. PATENT DOCUMENTS 5,613,880 A * 3/1997 Wang ..... H01R 24/42 439/541.5
5,791,918 A 8/1998 Pierce
(Continued)

FOREIGN PATENT DOCUMENTS

EP 1763115 A2 3/2007
EP 2830162 A1 1/2015
(Continued)

OTHER PUBLICATIONS

Office Action dated Oct. 14, 2016 of the corresponding Taiwan patent application.
(Continued)

*Primary Examiner* — Thanh Tam Le
(74) *Attorney, Agent, or Firm* — Chun-Ming Shih; HDLS IPR Services

(57) ABSTRACT

A socket outlet includes a main module and an expansion module. An expansion socket formed with a through hole, an inner annual groove, and an outer annual groove is disposed on the main module. Three electrodes are disposed on the expansion socket, respectively extended into the through hole, the inner annual groove, and the outer annual groove. An expansion plug including a conductive pin, an inner conductive ring, and an outer conductive ring is disposed on the expansion module. The expansion plug is plugged in the expansion socket, the conductive pin is plugged in the through hole, the inner conductive ring is plugged in the inner annual groove, and the outer conductive ring is plugged in the outer annual groove. The expansion module is connected to the main module by plugging the expansion plug into the expansion socket. The expansion module and the main module can be relatively rotated.

6 Claims, 17 Drawing Sheets

(51) Int. Cl.

| | |
|---|---|
| ***H01R 24/38*** | (2011.01) |
| ***H01R 25/00*** | (2006.01) |
| ***H01R 27/02*** | (2006.01) |
| ***H01R 35/04*** | (2006.01) |
| *H01R 105/00* | (2006.01) |
| *H01R 13/20* | (2006.01) |
| *H01R 13/627* | (2006.01) |
| *H01R 13/66* | (2006.01) |
| *H01R 9/24* | (2006.01) |

(52) U.S. Cl.
CPC ..... *H01R 35/04* (2013.01); *H01R 9/2458* (2013.01); *H01R 13/20* (2013.01); *H01R 13/6277* (2013.01); *H01R 13/6658* (2013.01); *H01R 2105/00* (2013.01)

(58) Field of Classification Search
USPC ..... 439/63, 171–175, 581, 582, 652, 620.03
See application file for complete search history.

(56) References Cited

U.S. PATENT DOCUMENTS 5,885,109 A * 3/1999 Lee ..... H01R 13/514 439/131
6,152,743 A * 11/2000 Fox ..... H01R 24/42 439/620.03
7,137,825 B2 * 11/2006 Myer ..... H01R 23/6873 439/579
7,497,740 B2 * 3/2009 Mei ..... H01R 13/514 200/51 R
7,914,344 B2 * 3/2011 Tin ..... H01R 13/64 439/668
8,197,260 B2 * 6/2012 Wadsworth ..... H01R 31/065 439/13
8,419,464 B2 * 4/2013 Montena ..... H01R 13/6683 439/489
8,430,675 B2 * 4/2013 Hardy ..... H01R 12/724 439/607.36
9,039,424 B2 * 5/2015 Camelio ..... H01R 24/50 439/581
9,385,489 B2 * 7/2016 Wang ..... H01R 13/70
2015/0001937 A1 1/2015 Wang

FOREIGN PATENT DOCUMENTS

| | | | |
|---|---|---|---|
| KR | 20130045053 | A | 5/2013 |
| TW | 220449 | U | 2/1994 |
| TW | M407530 | U | 7/2011 |
| TW | I455423 | B | 10/2014 |

OTHER PUBLICATIONS

Office Action dated Feb. 23, 2017 of the corresponding Korean patent application.
Communication issued by European Patent Office dated Sep. 27, 2017.

* cited by examiner

SOCKET OUTLET WITH EXPANSION MODULE

BACKGROUND OF THE INVENTION

Field of the Invention

The present invention relates to a socket outlet, especially to a socket outlet capable of being expanded according to actual needs and being rotated with respect to the operating space.

Description of Related Art

A socket outlet is a combination structure in which a plurality of socket is arranged in parallel, and is usually applied in an extension cord. When a plurality of the sockets arranged on a conventional socket outlet is in use, plugs plugged in the sockets may interfere with each other and the operation convenience is not provided. Moreover, when the quantity of the sockets is not as many as required, an additional socket outlet has to be purchased, so that the economic benefits are not provided.

Accordingly, the applicant of the present invention has devoted himself for improving the mentioned disadvantages.

SUMMARY OF THE INVENTION

The present invention is to provide a socket outlet capable of being expanded according to actual needs and being rotated with respect to the operating space.

Accordingly, the present invention provides a socket outlet including a main module and an expansion module. An expansion socket is disposed on the main module, and a through hole, an inner annular groove surrounding the through hole, and an outer annular groove surrounding the inner annular groove are formed on the expansion socket, three electrodes are disposed on the expansion socket, and the electrodes are respectively extended into the through hole, the inner annular groove and the outer annular groove. An expansion plug is disposed on the expansion module; a conductive pin, an inner conductive ring surrounding the conductive pin, and an outer conductive ring surrounding the inner conductive ring are disposed on the expansion plug. The expansion plug is plugged in the expansion socket, the conductive pin is plugged in the through hole, the inner conductive ring is plugged in the inner annular groove, and the outer conductive ring is plugged in the outer annular groove.

Preferably, the main module includes an AC output socket electrically connected to the expansion plug, and the electrodes are respectively and electrically connected in parallel with the AC output socket. The main module can also include a DC output socket electrically connected to the expansion plug.

Preferably, the expansion module includes an AC output socket electrically connected to the expansion plug. The expansion module includes a DC output socket electrically connected to the expansion plug, and the DC output socket is a female USB terminal. The expansion module includes another expansion socket. A latch tenon is moveably disposed on the expansion module and formed with a buckle hole, the conductive pin is formed with a latch slot, so that the conductive pin is able to pass the buckle hole and an inner edge of the buckle hole is latched in the latch slot. A resilient member used for recovering the latch tenon is disposed between the latch tenon and the expansion socket.

Preferably, a latch tenon is moveably disposed on the main module and formed with a buckle hole, the conductive pin is formed with a latch slot, so that the conductive pin is able to pass the buckle hole and an inner edge of the buckle hole is latched in the latch slot. A resilient member used for recovering the latch tenon is disposed between the latch tenon and the expansion socket. The main module includes a switch electrically connected to the AC output socket and the expansion socket.

Preferably, the socket outlet further includes another expansion module plugged in another expansion plug of the expansion socket on the expansion module.

According to the socket outlet provided by the present invention, the main module allows the expansion plug of the expansion module to be plugged in by utilizing the expansion socket for the purpose of expansion. Moreover, the expansion module can be connected to another expansion module for the purpose of expansion. Furthermore, the expansion module and the connected main module or the other expansion module can be relatively rotated for the purpose of angle adjustment.

DETAILED DESCRIPTION OF THE INVENTION

Preferred embodiments of the present invention will be described with reference to the drawings.

Figure 1:
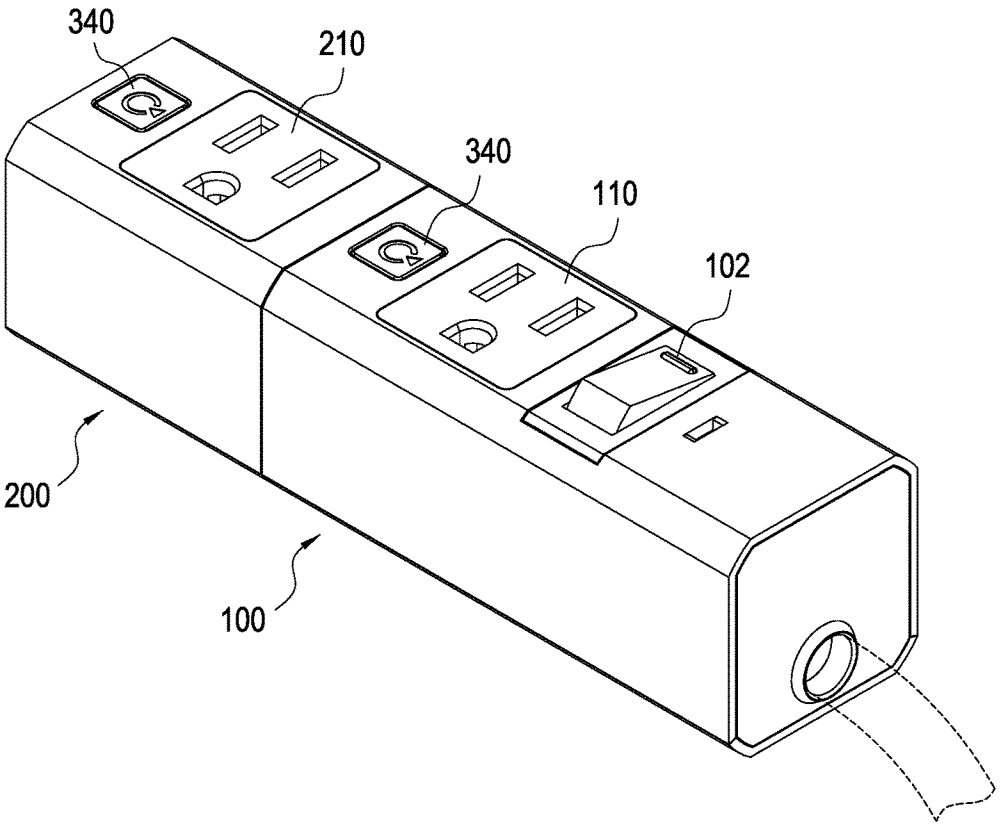
FIG. 1 is a perspective view showing a socket outlet according to a first embodiment of the present invention.
Figure 2:
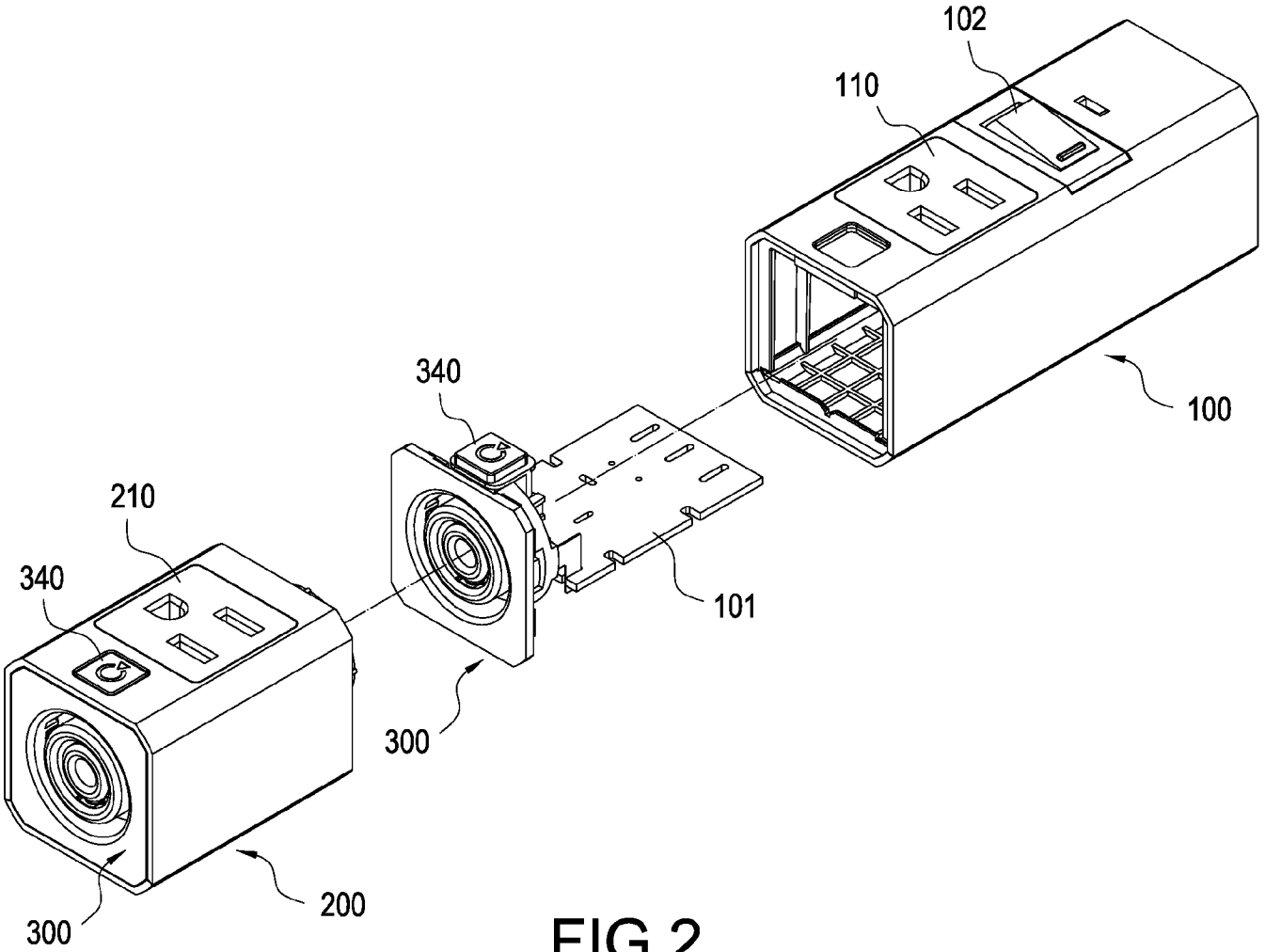
FIG. 2 is a perspective exploded view showing the socket outlet according to the first embodiment of the present invention.

Please refer to FIG. 1 and FIG. 2, according to a first embodiment of the present invention, a socket outlet including a main module 100 and an expansion module 200 connected to the main module 100.

According to this embodiment, the main module 100 is preferably to be in a columnar status, a main circuit board 101 is disposed in the main module 100, and the main circuit board 101 is connected to a public power, so that the public power can be inputted into the main module 100. The main module 100 is provided with an AC output socket 110 exposed on a lateral surface of the main module 100 (what shall be addressed is that the scope of the present invention is not limited to the above-mentioned AC output socket; a DC output socket can also be adopted), the AC output socket 110 is electrically connected to the main circuit board 101, and one end of the main module 100 is provided with an expansion socket 300 which is electrically connected to the main circuit board 101. A switch 102 is disposed on the main module 100, and the switch 102 is connected to the main circuit board 101 and electrically connected to the AC output socket 110 and the expansion socket 300, so that the public power can be controlled for supplying or terminating the electric power to the AC output socket 110 and the expansion socket 300.

Figure 3:
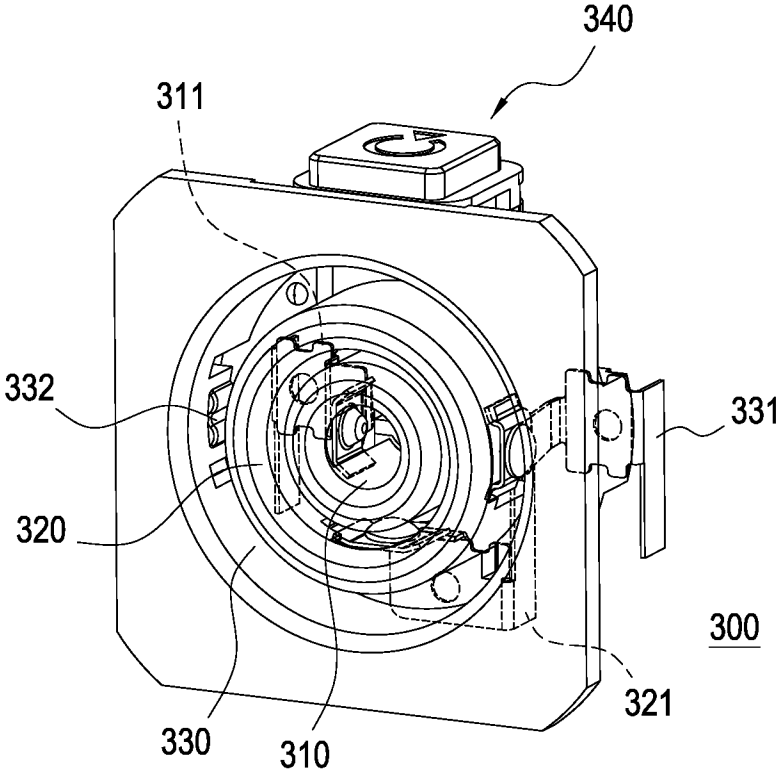
FIG. 3 is a perspective view showing an expansion socket according to the first embodiment of the present invention.
Figure 5:
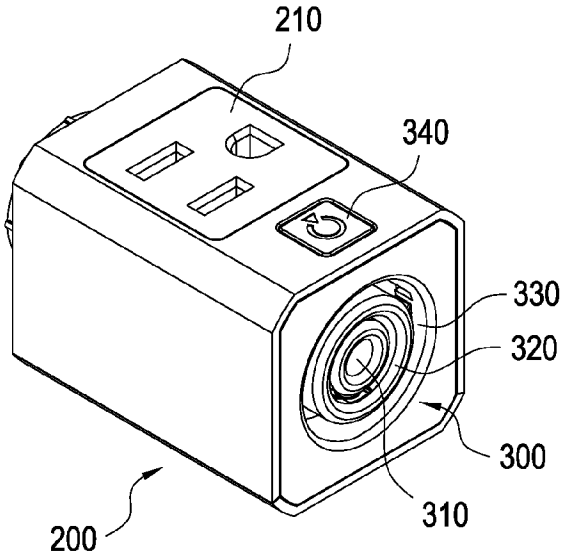
FIG. 5 is another perspective view showing the expansion module according to the first embodiment of the present invention.
Figure 4:
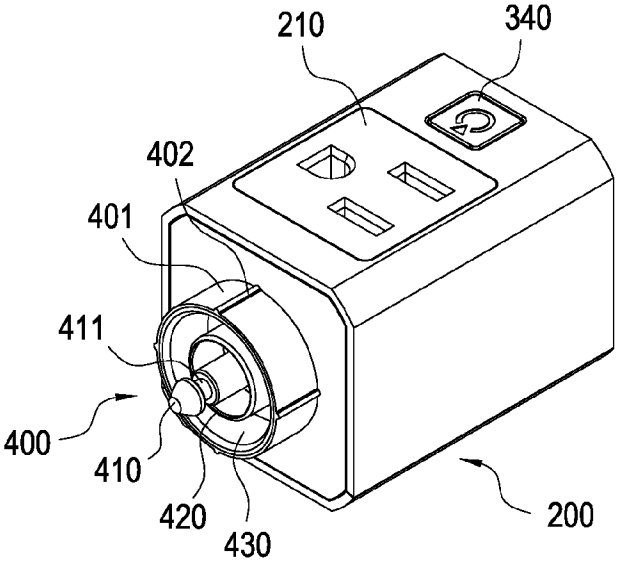
FIG. 4 is a perspective view showing an expansion module according to the first embodiment of the present invention.
Figure 6:
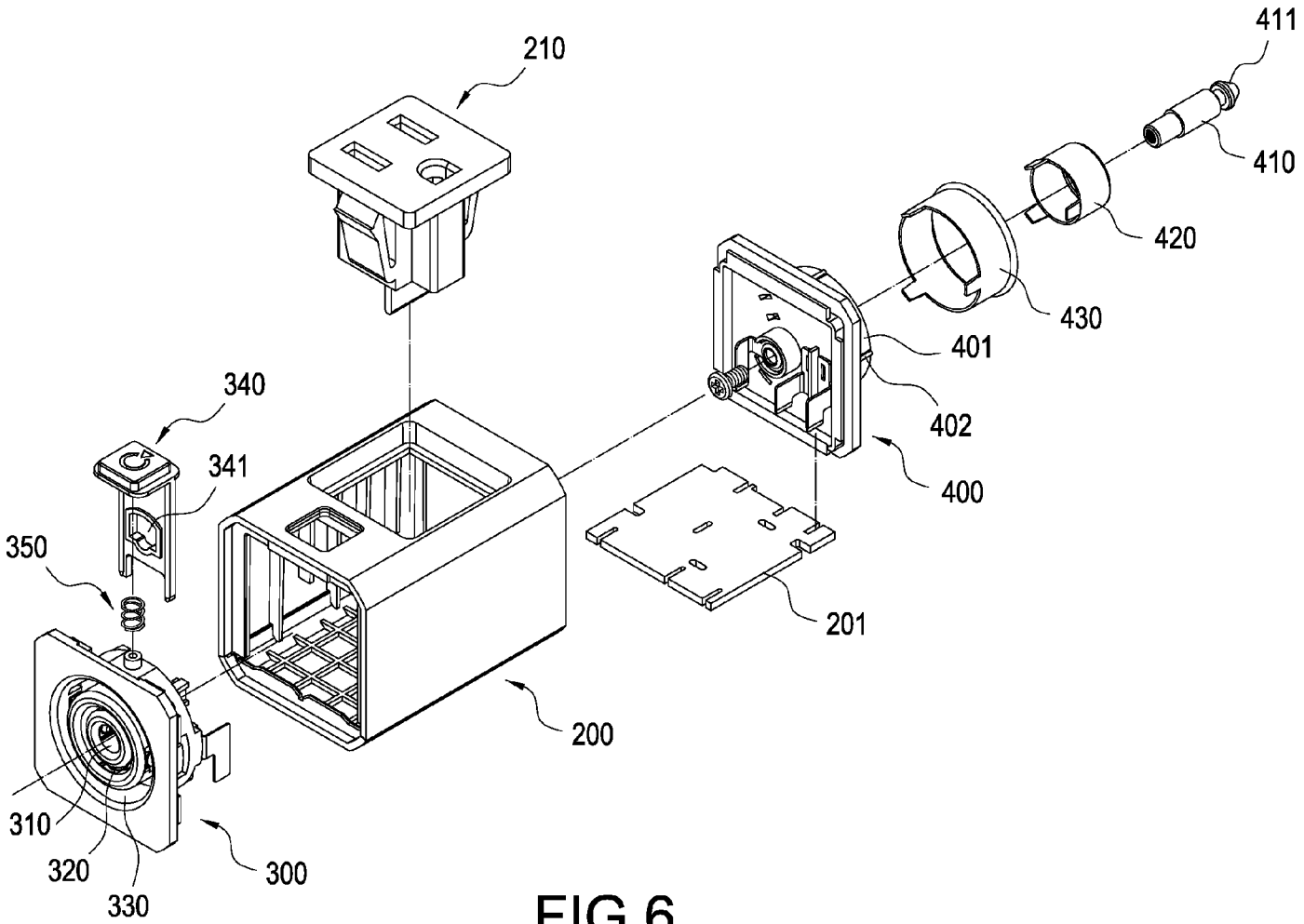
FIG. 6 is a perspective exploded view showing the expansion module according to the first embodiment of the present invention.
Figure 7:
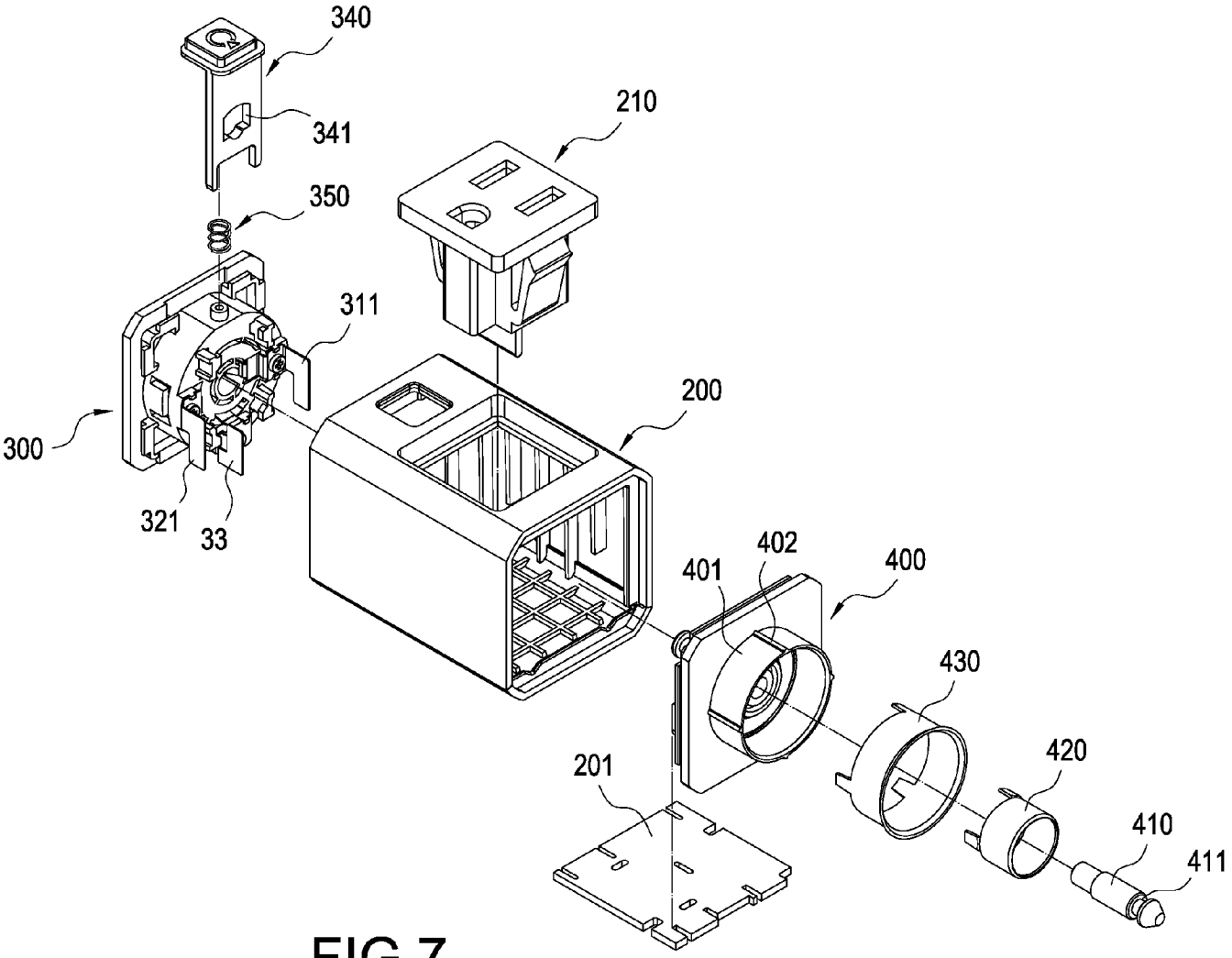
FIG. 7 is another perspective exploded view showing the expansion module according to the first embodiment of the present invention.

Please refer to FIG. 3. According to this embodiment, the expansion socket 300 is preferably to be formed as an insulation seat member made of plastic, a through hole 310, an inner annular groove 320 surrounding the through hole 310, and an outer annular groove 330 surrounding the inner annular groove 320 are formed on the expansion socket 300, and at least one positioning slot 332 is formed on a wall of the outer annular groove 330. Three electrodes 311, 321, 331 are disposed on the expansion socket 300, and one end of each of the electrodes 311, 321, 331 is respectively extended into the through hole 310, the inner annular groove 320 and the outer annular groove 330. Another end of each of the electrodes 311, 321, 331 of the expansion socket 300 on the main module 100 is respectively connected to the main circuit board 101 so as to be electrically connected in parallel with the AC output socket 110 of the main module 100. Similarly, another end of each electrode 311, 321, 331 of another expansion socket 300 on the expansion module 200 is respectively connected to an expansion circuit board 201 so as to be electrically connected in parallel with an AC output socket 210 of the expansion module 200 and an expansion plug 400.

Please refer from FIG. 4 to FIG. 7. According to this embodiment, the expansion module 200 is preferably in a columnar status, and the above-mentioned expansion circuit board 201 is disposed in the expansion module 200. The expansion module 200 is provided with the above-mentioned AC output socket 210 which is exposed on a lateral surface of the expansion module 200, two ends of the expansion module 200 are respectively provided with the above-mentioned expansion plug 400 and the above-mentioned expansion socket 300, and the AC output sockets 110, 210, the expansion plug 400 and the expansion socket 300 are respectively and electrically connected to the expansion circuit board 201 so as to be mutually and electrically connected in parallel.

According to this embodiment, the expansion plug 400 is preferably formed as an insulation seat member made of plastic, a conductive pin 410, an inner conductive ring 420 surrounding the conductive pin 410, and an outer conductive ring 430 surrounding the inner conductive ring 420 are disposed on the expansion plug 400, and the conductive pin 410, the inner conductive ring 420 and the outer conductive ring 430 are respectively and electrically connected to the expansion circuit board 201. An outer annular wall 401 surrounding the outer conductive ring 430 is formed on the expansion plug 400, and a plurality of positioning ribs 402 are outwardly protruded from the outer annular wall 401.

Figure 8:
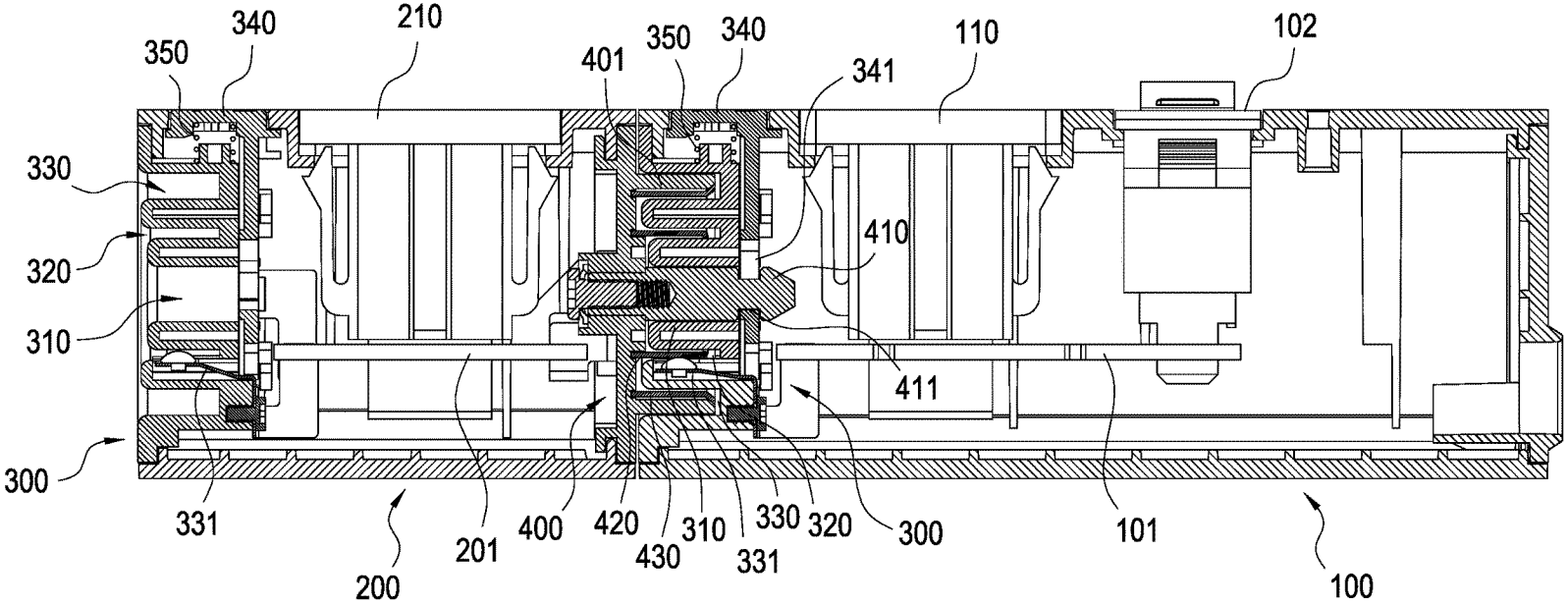
FIG. 8 is a longitudinal cross sectional view showing the socket outlet according to the first embodiment of the present invention.
Figure 9:
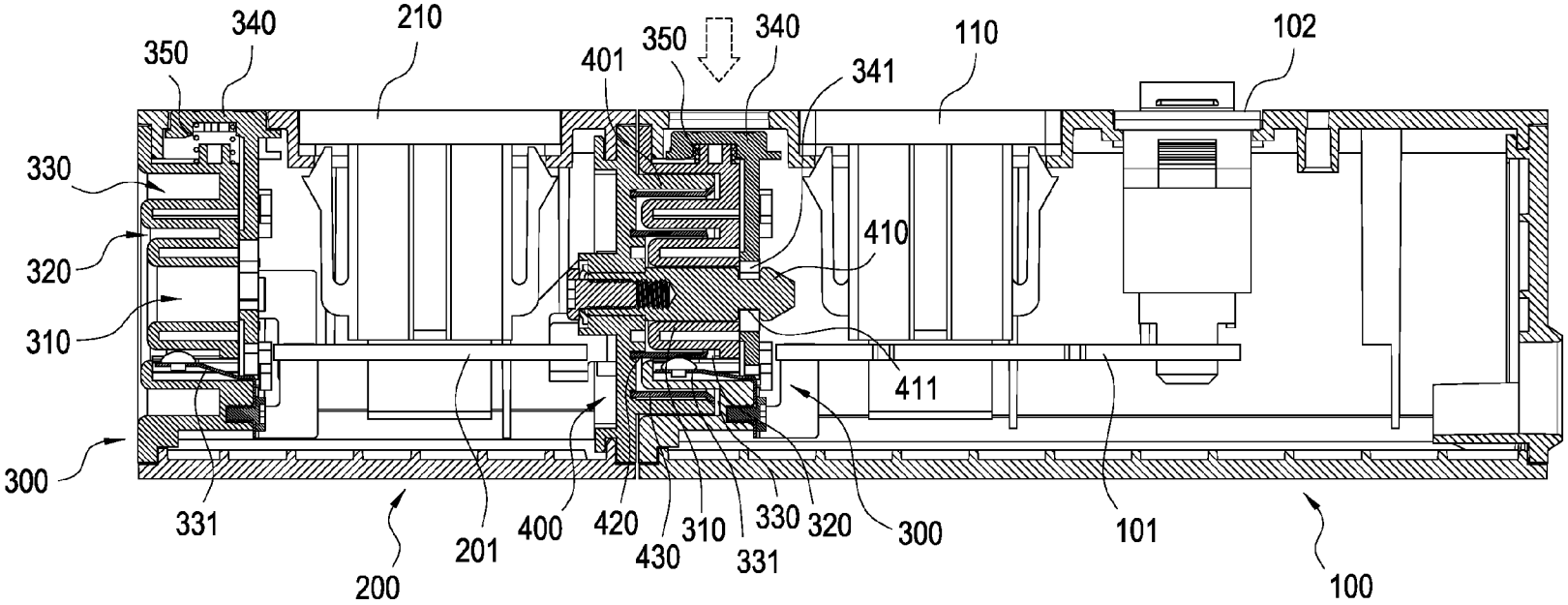
FIG. 9 is another longitudinal cross sectional view showing the socket outlet according to the first embodiment of the present invention.

Referring to FIG. 8 and FIG. 9, the expansion plug 400 is able to be plugged in the expansion socket 300 for being mutually and electrically connected. When the expansion plug 400 is plugged in the expansion socket 300, the conductive pin 410 is plugged in the through hole 310 so as to be conducted with the electrode 311 extended into the through hole 310, the inner conductive ring 420 is plugged in the inner annular groove 320 so as to be conducted with the electrode 321 extended into the inner annular groove 320, and the outer conductive ring 430 is plugged in the outer annular groove 330 so as to be conducted with the electrode 331 extended into the outer annular groove 330.

A latch tenon 340 is moveably disposed on the main module 100 and formed with a buckle hole 341, the location of the buckle hole 341 is corresponding to the through hole 310 of the expansion socket 300 on the main module 100, and a resilient member 350 used for recovering the latch tenon 340 is disposed between the latch tenon 340 and the expansion socket 300. The resilient member 350 is abutted against the latch tenon 340 for enabling an inner edge of the buckle hole 341 to shield a part of the through hole 310. A latch slot 411 in an annular status is formed on a lateral surface of the conductive pin 410. When the conductive pin 410 is plugged in the through hole 310, the conductive pin 410 is able to pass the buckle hole 341 and the inner edge of the buckle hole 341 is latched in the latch slot 411 thereby fastening the conductive pin 410, so that the expansion socket 300 can be mutually fastened with the expansion plug 400. When the expansion plug 400 is desired to be removed from the expansion socket 300, the latch tenon 340 is pushed for enabling the inner edge of the buckle hole 341 to retract from the conductive pin 410, thereby allowing the conductive pin 410 to be released from the buckle hole 341.

Another latch tenon 340 is moveably disposed on the expansion module 200, which is the same as the above mentioned, and the arrangement thereof is also the same as the above mentioned, which is corresponding to the expansion socket 300 on the expansion module 200.

Figure 11:
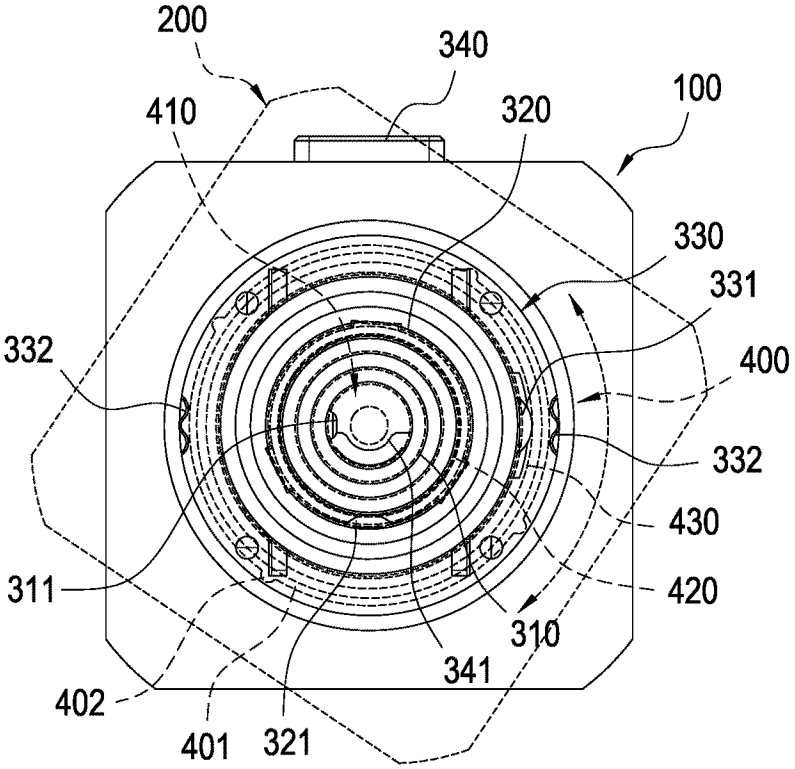
FIG. 11 is another schematic view showing the socket outlet being rotated according to the first embodiment of the present invention.
Figure 10:
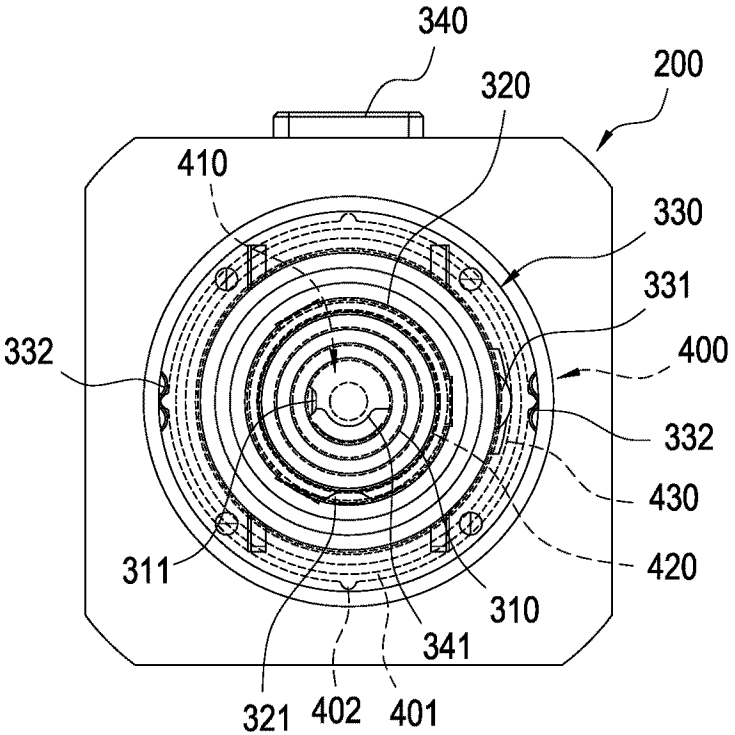
FIG. 10 is a schematic view showing the socket outlet being rotated according to the first embodiment of the present invention.
Figure 12:
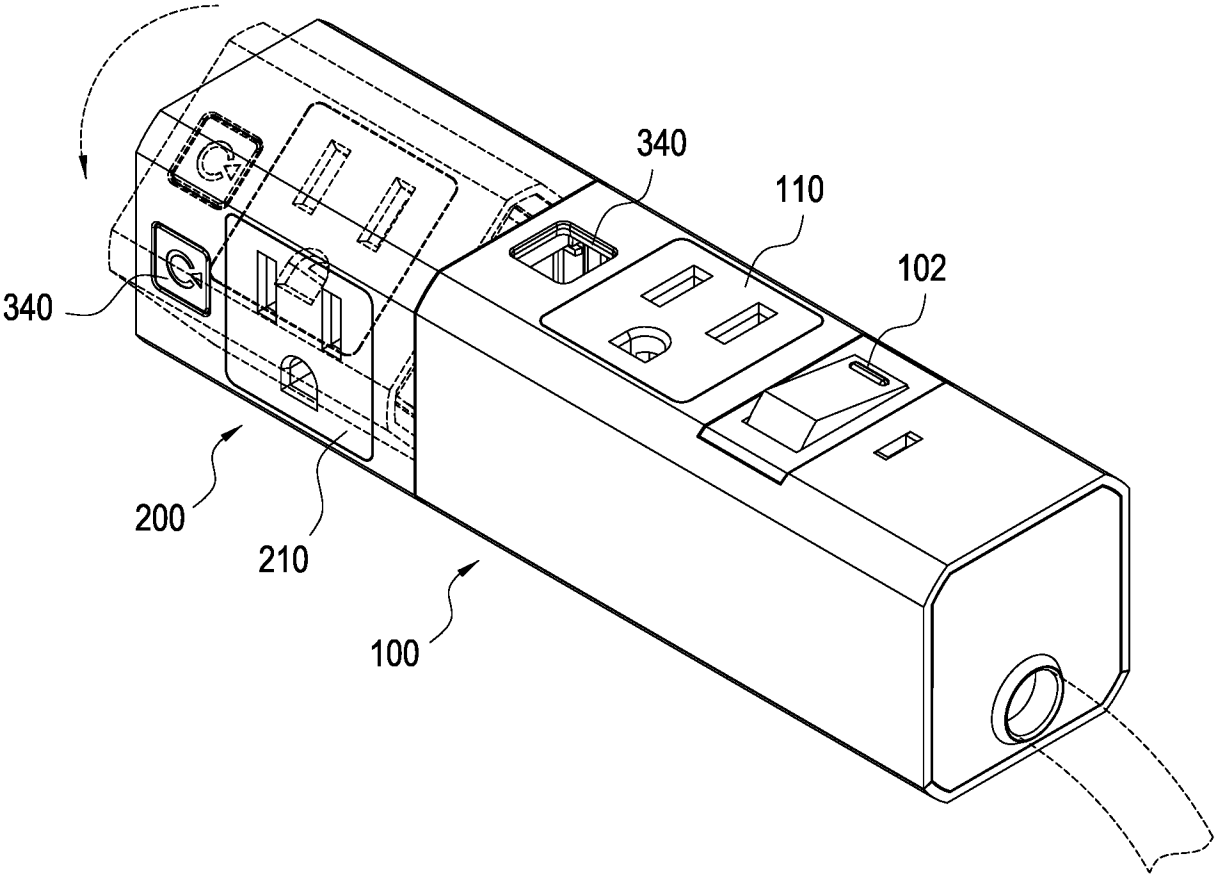
FIG. 12 is a perspective view showing the rotation of the socket outlet according to the first embodiment of the present invention.

Referring from FIG. 10 to FIG. 12, the expansion module 200 is connected to the main module 100 by plugging the expansion plug 400 in the expansion socket 300, and the AC output socket 110 of the main module 100 and the AC output socket 210 of the expansion module 200 are electrically connected in parallel by connecting the expansion socket 300 and the expansion plug 400. Moreover, the conductive pin 410 is able to axially rotate in the through hole 310, the inner conductive ring 420 is able to axially rotate in the inner annular groove 320, and the outer conductive ring 430 is able to axially rotate in the outer annular groove 330, so that the expansion plug 400 and the expansion socket 300 can relatively rotate for enabling the main module 100 and the expansion module 200 to relatively rotate. When the expansion plug 400 and the expansion socket 300 are relatively rotated, any of the positioning ribs 402 on the expansion plug 400 can be selectively positioned in any of the positioning slots 332 of the outer annular groove 330 for fixing a relative angle formed between the main module 100 and the expansion module 200.

Figure 13:
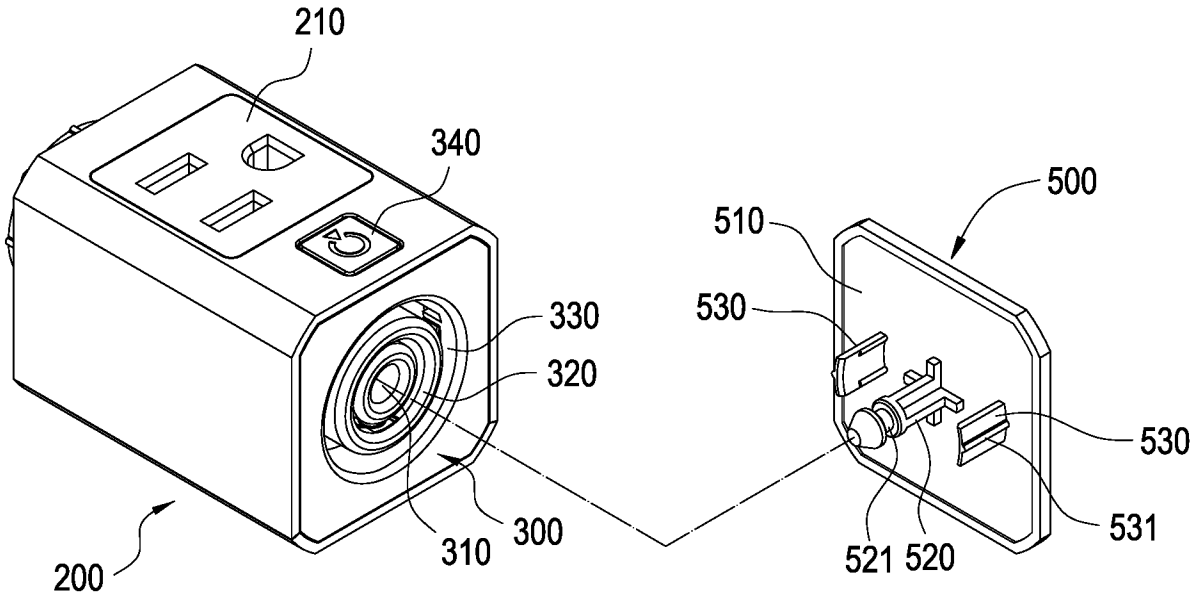
FIG. 13 is a perspective view showing a dustproof cover of the socket outlet according to the first embodiment of the present invention.

Please refer to FIG. 3 and FIG. 13. When the expansion socket 300 is not in use, a dustproof cover 500 can be provided for covering and protecting, and the dustproof cover 500 includes a cover plate 510 covering the through hole 310, the inner annular groove 320 and the outer annular groove 330 of the expansion socket 300. A connection pin 520 and an arc-shaped piece 530 are protruded from a lateral surface of the cover plate 510, and a latch slot 521 in an annular status is formed on a lateral surface of the connection pin 520. When the connection pin 520 is plugged in the through hole 310 of the expansion socket 300, the connection pin 520 is able to pass the buckle hole 341 of the latch tenon 340 and the inner edge of the buckle hole 341 is latched in the latch slot 521 thereby fastening the connection pin 520, so that the dustproof cover 500 can be fastened on the expansion socket 300. The arc-shaped piece 530 is plugged in the outer annular groove 330 and a positioning rib 531 is formed on a convex surface of the arc-shaped piece 530. The positioning rib 531 is able to be connected to any of the positioning slots 332 in the outer annular groove 330, so that the dustproof cover 500 is fastened and unable to be rotated. When the dustproof cover 500 is desired to be removed from the expansion socket 300, the latch tenon 340 is pushed for enabling the inner edge of the buckle hole 341 to retract from the connection pin 520, thereby allowing the connection pin 520 to be released from the buckle hole 341.

Figure 14:
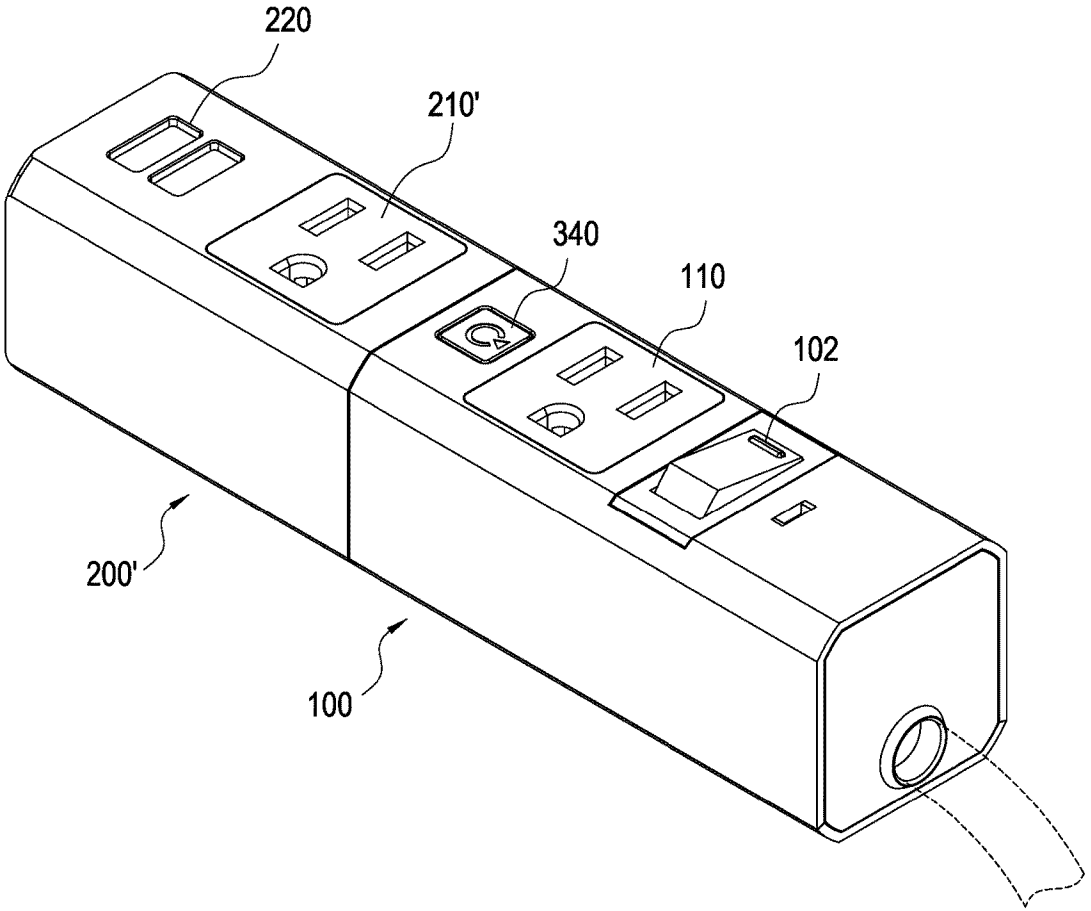
FIG. 14 is a perspective view showing the socket outlet according to a second embodiment of the present invention.
Figure 15:
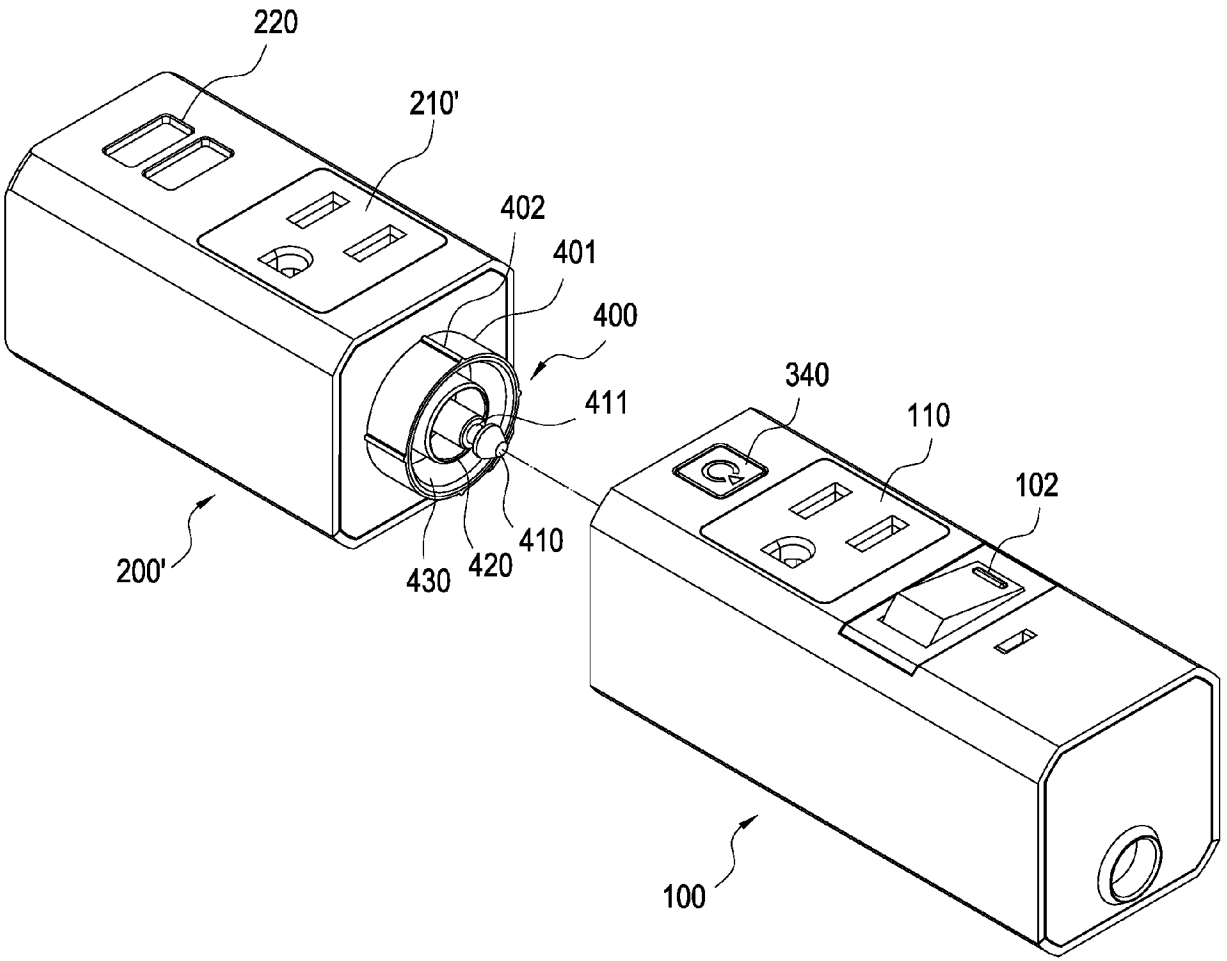
FIG. 15 is a perspective exploded view showing the socket outlet according to the second embodiment of the present invention.
Figure 16:
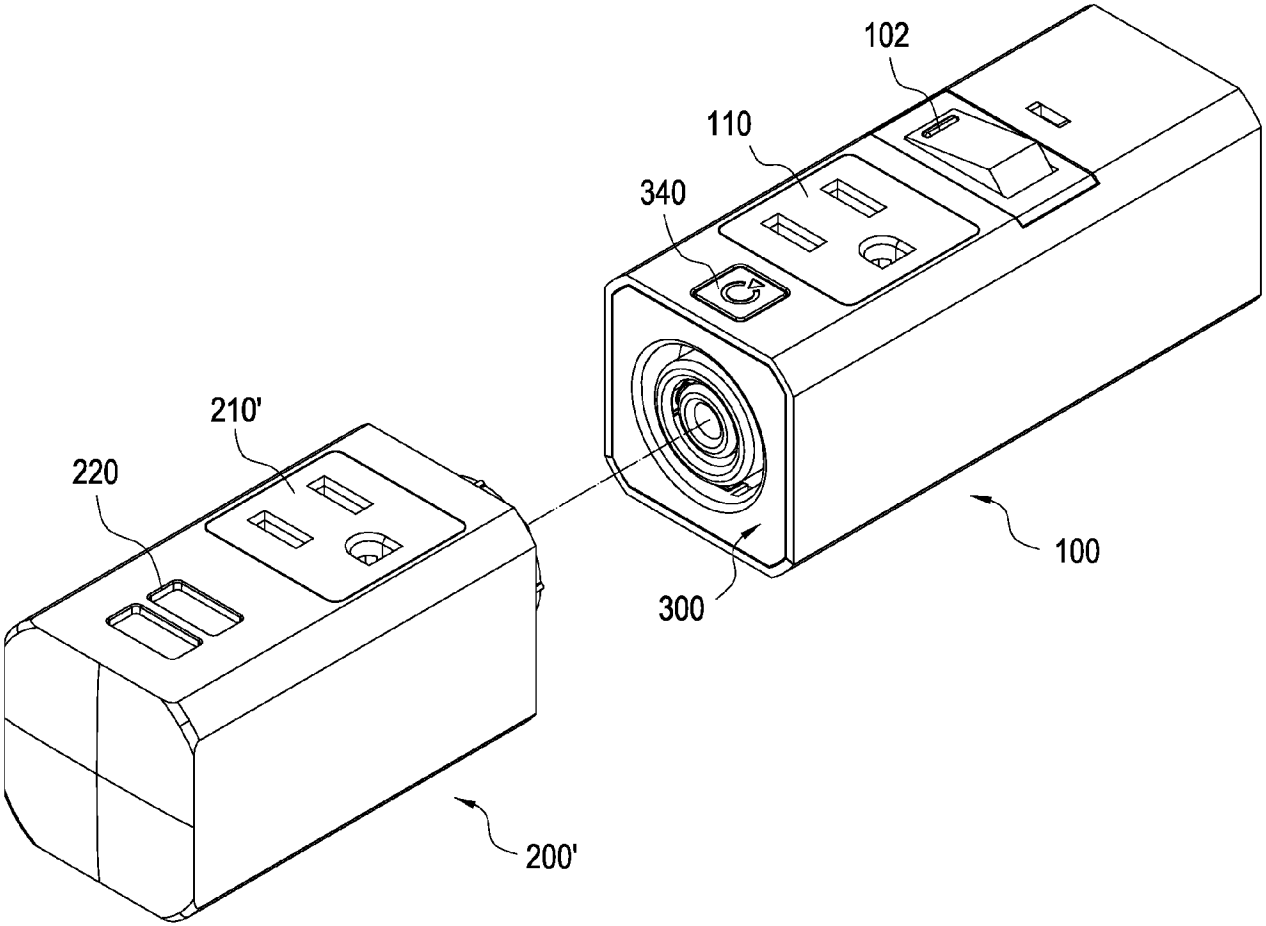
FIG. 16 is another perspective exploded view showing the socket outlet according to the second embodiment of the present invention.

Please refer from FIG. 14 to FIG. 16, according to a second embodiment of the present invention, a socket outlet including a main module 100 and an expansion module 200' connected to the main module 100. The structure of the main module 100 is the same as the above mentioned, the structure of the expansion module 200' is substantially as the same as the first embodiment, thus no further illustration is provided for the same structure.

The difference between the second embodiment and the first embodiment is that the expansion module 200' includes an AC output socket 210' and a DC output socket 220, and the DC output socket 220 is preferably to be a female USB terminal. The DC output socket 220 is preferably to be electrically connected to the expansion circuit board 201 in the expansion module 200', the expansion plug 400 is electrically connected to the main module 100, and the main module 100 is able to supply the public power to the expansion circuit board 201 through the expansion plug 400 on the main module 100 and the expansion socket 300 on expansion module 200', so that the expansion circuit board 210 is able to the supply the AC power to the AC output socket 210', and the DC power is able to be converted for being supplied to the DC output socket 220.

Figure 17:
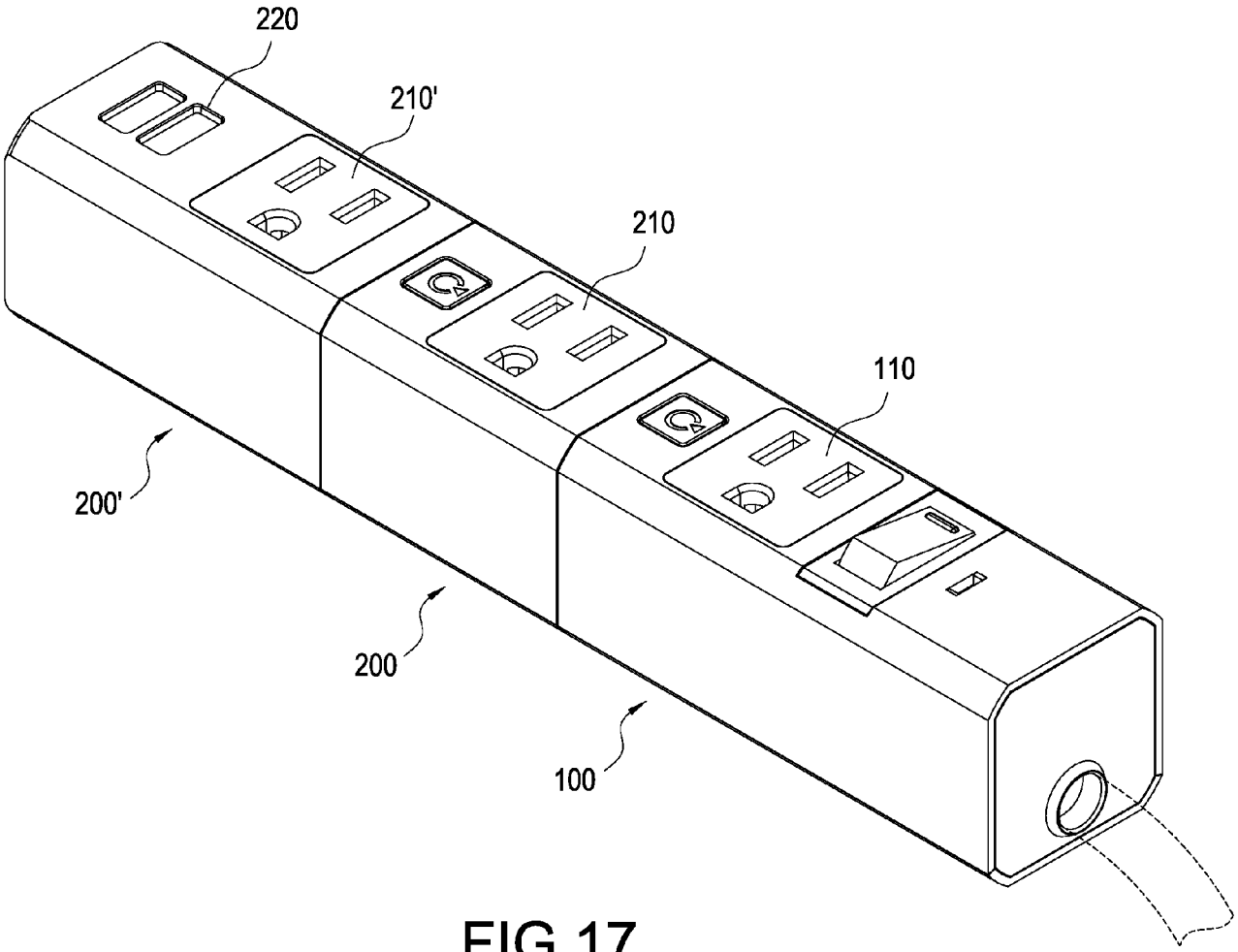
FIG. 17 is a perspective view showing the socket outlet according to a third embodiment of the present invention.
Figure 18:
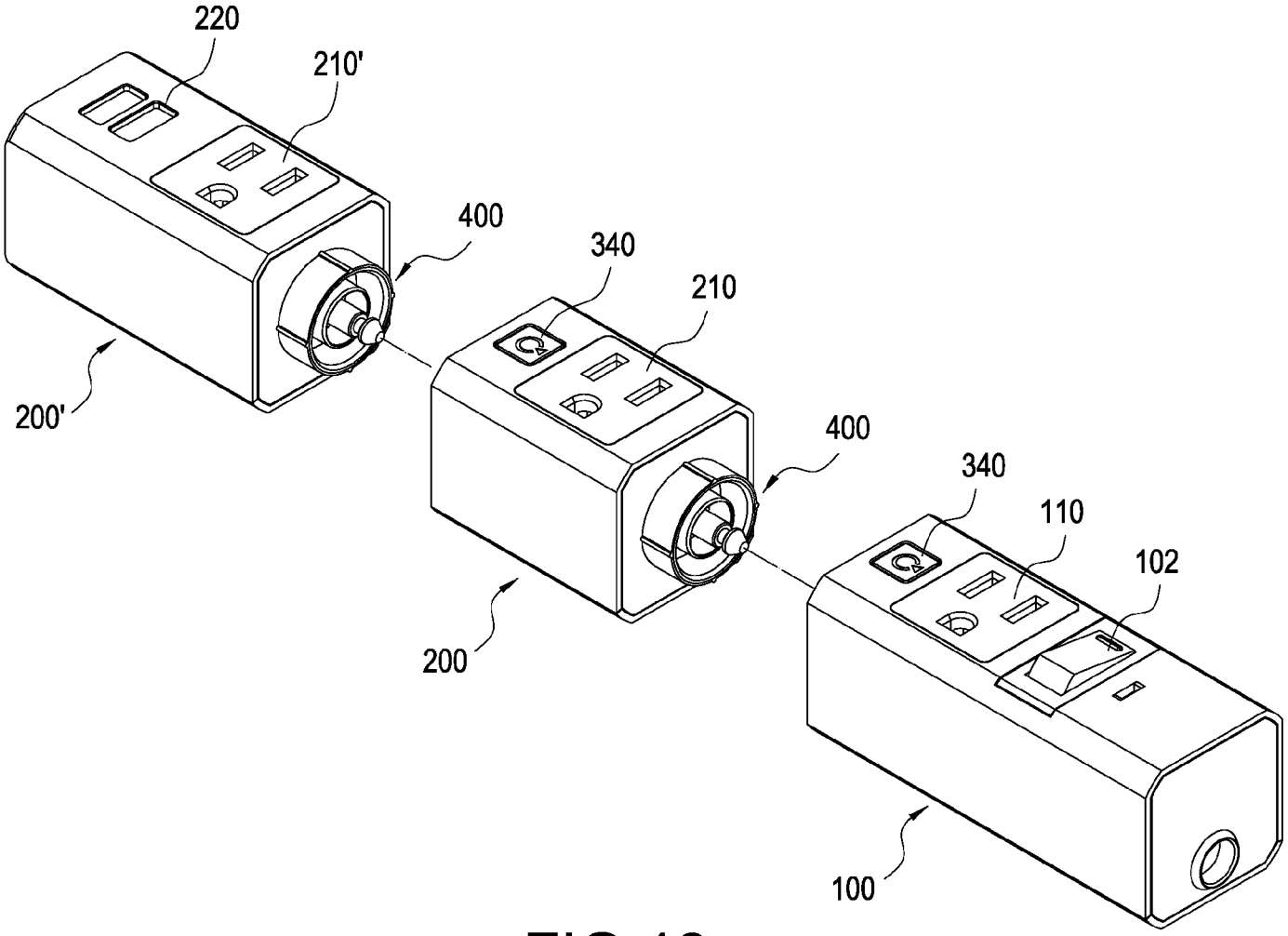
FIG. 18 is a perspective exploded view showing the socket outlet according to the third embodiment of the present invention.
Figure 19:
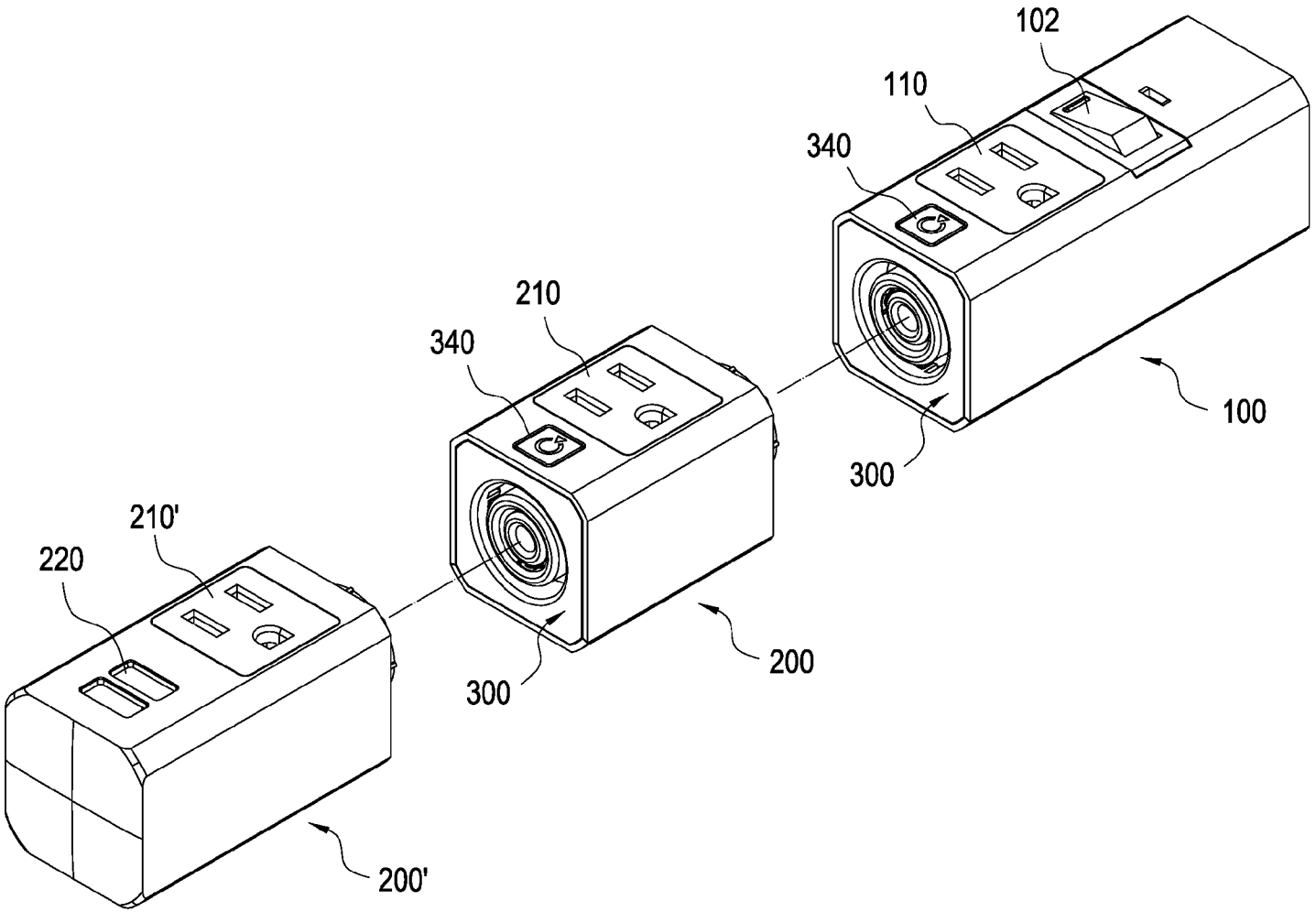
FIG. 19 is another perspective exploded view showing the socket outlet according to the third embodiment of the present invention.

Please refer from FIG. 17 to FIG. 19, according to a third embodiment of the present invention, a socket outlet including a main module 100 and a plurality of expansion modules 200. According to this embodiment, there are preferably two of the expansion modules 200, 200', but what shall be addressed is that the scope of the present invention is limited to the quantity of the expansion modules 200, 200'. The expansion modules 200, 200' are respectively and selectively connected to the main module 100, and the two expansion modules 200, 200' can be optionally connected with each other.

The main module 100 and the expansion module 200 connected to the main module 100 are the same as the first embodiment, therefore no further illustration is provided. An AC output socket 210', a DC output socket 220 and an expansion plug 400 are disposed on the other expansion module 200', the expansion plug 400 is plugged in the expansion socket 300 of the above-mentioned expansion module 200, so that the two expansion modules 200, 200' are connected with each other thereby enabling the two expansion modules 200, 200' to be electrically connected and to be relatively rotated. As such, the main module 100 is able to supply the public power to the AC output sockets 110, 210, 210' and the DC output socket 220. The relative angle defined between the expansion module 200 and the connected main module 100 or the other expansion module 200' can be fixed by positioning the positioning rib 402 in the positioning slot 332.

According to the socket outlet provided by the present invention, the main module 100 allows the expansion plug 400 of any of the expansion modules 200, 200' to be plugged in by utilizing the expansion socket 300, so that the AC output sockets 210, 210' or the DC output socket 220 can be expanded. Moreover, the expansion socket 300 on the expansion module 200 allows the expansion plug 400 on the other expansion module 200' to be plugged in for the purpose of further expansion. Furthermore, the expansion module 200 and the connected main module 100 or the other expansion module 200' can be relatively rotated for the purpose of angle adjustment.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A socket outlet, including:

a main module, disposed with an expansion socket, wherein a through hole, an inner annular groove surrounding the through hole, and an outer annular groove surrounding the inner annular groove are formed on the expansion socket, three electrodes are disposed on the expansion socket, and the electrodes are respectively extended into the through hole, the inner annular groove and the outer annular groove; and an expansion module, disposed with an expansion plug, wherein a conductive pin, an inner conductive ring surrounding the conductive pin and an outer conductive ring surrounding the inner conductive ring are disposed on the expansion plug;

wherein, the expansion plug is plugged in the expansion socket, the conductive pin is plugged in the through hole, the inner conductive ring is plugged in the inner annular groove, and the outer conductive ring is plugged in the outer annular groove;

wherein a latch tenon is moveably disposed on the expansion module and formed with a buckle hole, and the conductive pin is formed with a latch slot, so that the conductive pin is able to pass the buckle hole and an inner edge of the buckle hole is latched in the latch slot.

2. The socket outlet according to claim 1, wherein the main module includes an AC output socket electrically connected to the expansion plug, and the electrodes are respectively and electrically connected in parallel with the AC output socket.

3. The socket outlet according to claim 1, wherein the main module includes a DC output socket electrically connected to the expansion plug.

4. The socket outlet according to claim 1, wherein the expansion module includes an AC output socket electrically connected to the expansion plug.

5. The socket outlet according to claim 1, wherein a resilient member used for recovering the latch tenon is disposed between the latch tenon and the expansion socket.

6. The socket outlet according to claim 1, wherein the main module includes a switch electrically connected to the AC output socket and the expansion socket.

* * * * *